US008347840B2

(12) United States Patent
Fleckner et al.

(10) Patent No.: US 8,347,840 B2
(45) Date of Patent: Jan. 8, 2013

(54) PROCESS AND SYSTEM FOR STARTING A DIRECT-INJECTING INTERNAL-COMBUSTION ENGINE AS WELL AS MOTOR VEHICLE

(75) Inventors: Marco Fleckner, Leonberg (DE); Dietmar Schwarzenthal, Ditzingen (DE)

(73) Assignee: Dr. Ing. h.c.F. Porsche Aktiengesellschaft (DE)

( * ) Notice: Subject to any disclaimer, the term of this patent is extended or adjusted under 35 U.S.C. 154(b) by 164 days.

(21) Appl. No.: 12/239,365

(22) Filed: Sep. 26, 2008

(65) Prior Publication Data

US 2009/0188459 A1 Jul. 30, 2009

(30) Foreign Application Priority Data

Sep. 29, 2007 (DE) ..... 10 2007 046 819

(51) Int. Cl.
*F01L 1/34* (2006.01)

(52) U.S. Cl. ..... 123/179.3; 123/90.16

(58) Field of Classification Search .... 123/90.15–90.18, 123/179.3, 179.28
See application file for complete search history.

(56) References Cited

U.S. PATENT DOCUMENTS

| | | | | |
|---|---|---|---|---|
| 5,174,253 | A * | 12/1992 | Yamazaki et al. | 123/90.17 |
| 5,209,194 | A * | 5/1993 | Adachi et al. | 123/90.17 |
| 5,657,728 | A * | 8/1997 | Diggs | 123/192.2 |
| 6,098,585 | A * | 8/2000 | Brehob et al. | 123/179.5 |
| 6,129,061 | A | 10/2000 | Okuda et al. | |
| 6,971,357 | B2 * | 12/2005 | Grieser et al. | 123/179.18 |
| 7,047,923 | B2 * | 5/2006 | Schafer et al. | 123/90.16 |
| 7,182,052 | B2 * | 2/2007 | Yaoko et al. | 123/90.17 |
| 7,461,621 | B2 * | 12/2008 | Ota et al. | 123/179.4 |
| 7,571,709 | B2 * | 8/2009 | Lewis et al. | 123/320 |
| 7,603,223 | B2 | 10/2009 | Moriya | |

FOREIGN PATENT DOCUMENTS

| | | |
|---|---|---|
| EP | 1 367 256 A1 | 12/2003 |
| JP | 11141361 | 5/1999 |
| JP | 2000225859 | 8/2000 |
| JP | 2000328974 | 11/2000 |
| JP | 2001248810 | 9/2001 |
| JP | 2005030294 | 2/2005 |
| JP | 2006046213 | 2/2006 |
| JP | 2006177179 | 7/2006 |
| WO | 2005042942 | 5/2005 |

* cited by examiner

*Primary Examiner* — Mahmoud Gimie
*Assistant Examiner* — David Hamaoui
(74) *Attorney, Agent, or Firm* — Gerald E. Hespos; Michael J. Porco

(57) ABSTRACT

A process for starting a direct-injecting internal-combustion engine is disclosed. The process includes triggering a separate drive for adjusting the camshaft for causing an angular position change between the crankshaft and the camshaft until the separate drive rotates the crankshaft such that a working medium is compressed by a piston in a cylinder of the internal-combustion engine. The position of the pistons of the internal-combustion engine is determined by using position determining devices to identify the cylinder of the internal-combustion engine in which the working medium is compressed. Fuel is injected into the cylinder in which the working medium is compressed when the cylinder is in a proximity of an upper dead center to start the internal-combustion engine.

11 Claims, 1 Drawing Sheet

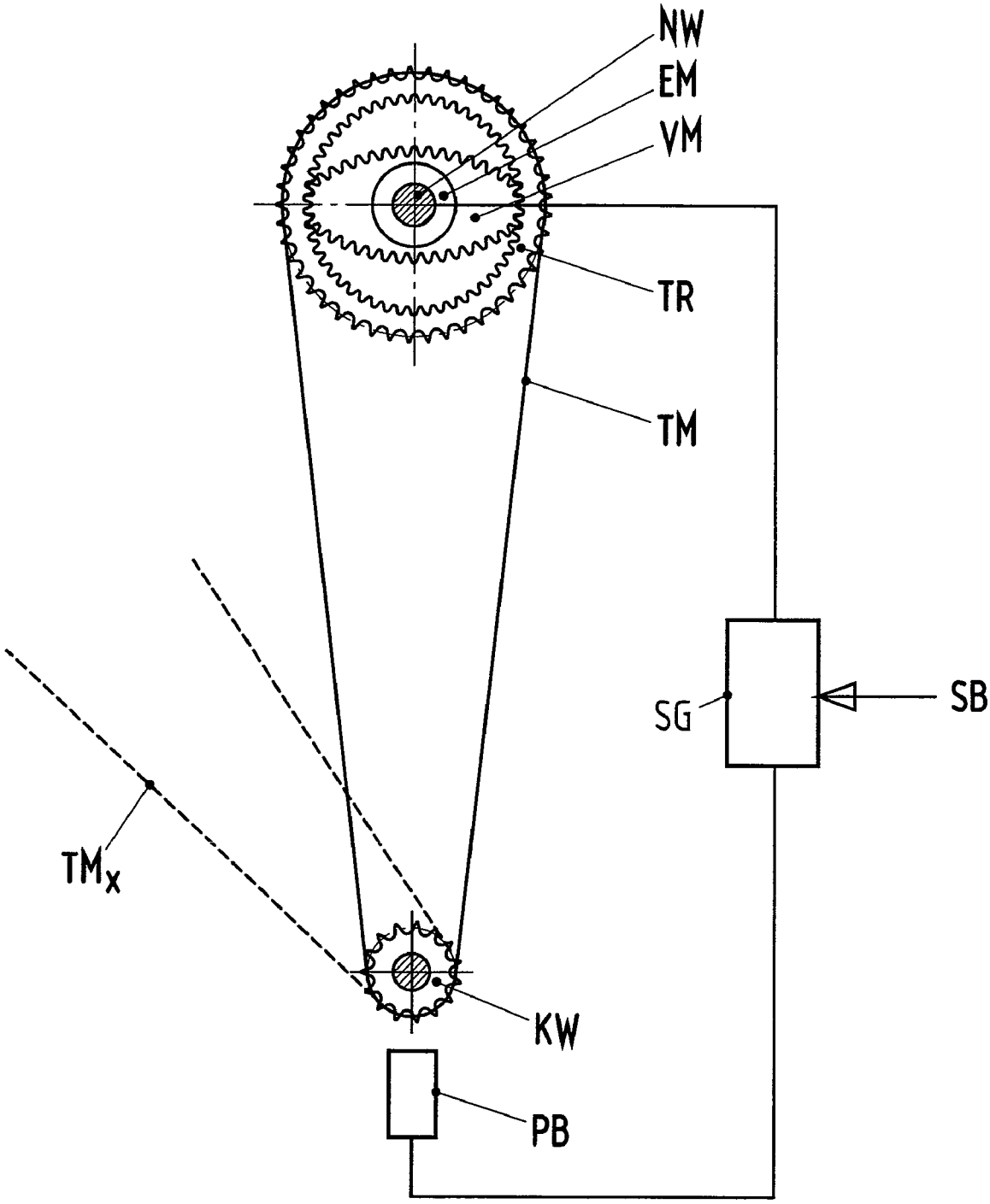
NW
EM
VM
TR
TM
SG
SB
TMx
KW
PB

PROCESS AND SYSTEM FOR STARTING A DIRECT-INJECTING INTERNAL-COMBUSTION ENGINE AS WELL AS MOTOR VEHICLE

This application claims the priority of German Patent Document No. 10 2007 046 819.0, filed Sep. 29, 2007, the disclosure of which is expressly incorporated by reference herein.

BACKGROUND AND SUMMARY OF THE INVENTION

The invention relates to a process or starting a direct-injecting internal-combustion engine, to a corresponding system, as well as to a corresponding motor vehicle.

The internal-combustion engine of a motor vehicle is normally started by a starter motor, such as a pinion starter. In the case of hybrid vehicles, thus, in the case of motor vehicles which, in addition to the internal-combustion engine, have at least one additional electric machine, this electric machine can take over the function of the starter motor and the latter can therefore be eliminated.

It is an object of the invention to indicate a further process as well as a corresponding system for starting an internal-combustion engine.

According to the invention, a process for starting a direct-injecting internal-combustion engine comprises at least the following steps. Triggering a separate drive, whereby the crankshaft of the internal-combustion engine, by way of mechanical driving devices, which comprise an adjusting mechanism having the separate drive is provided for driving a camshaft of the internal-combustion engine, for adjusting the camshaft in order to cause by way of the adjusting mechanism an angular-position change between the crankshaft and the camshaft until the separate drive of the adjusting mechanism rotates the crankshaft by way of the mechanical driving devices and thus a working medium is compressed in at least one cylinder of the internal-combustion engine by means of the piston. Then, the process includes determining the position of the pistons by using position determining devices and thus identifying the cylinder of the internal-combustion engine in which the working medium is compressed. Further, the process includes injecting fuel into this cylinder when the cylinder is in the proximity of its upper dead center, for starting the internal-combustion engine. In other words, the invention utilizes the separate drive of a camshaft adjusting device for starting the internal-combustion engine. For this purpose, during a stoppage of the internal-combustion engine, an "inverse" operation of the camshaft adjusting device takes place for a short time in that its separate drive is therefore utilized for driving the crankshaft of the internal-combustion engine by way of the mechanical driving devices. The separate drive of the camshaft adjusting device is therefore quasi reworked as a starter motor. In this case, the camshaft adjusting device adjusts only the control timing of the camshaft with respect to the crankshaft; the valve opening period and the valve stroke of the internal-combustion engine are not changed by this phase adjustment. The invention is based on the recognition that the angular-position change between the crankshaft and the camshaft caused by means of the separate drive, in each case, affects that shaft which has the lower moment of resistance. In the case of the moment of resistance, for example, the friction, the moments of compression for compressing the cylinders or the operating moments of the valves at the camshaft are to be taken into account.

Particularly preferably, the separate drive is triggered in the first step until a cam rests approximately on the stop of a valve of the internal-combustion engine, and is subsequently triggered further, in which case the cam resting on the stop of the valve now supports itself on this valve and thereby blocks the camshaft, whereby the separate drive now rotates the crankshaft by way of the mechanical driving devices. In the case of a corresponding design, this permits a reliable use of the invention.

In a first preferred embodiment of the invention, the internal-combustion engine is provided as a direct-injecting diesel engine, in which case diesel fuel is injected in the proximity of the upper dead center, which diesel fuel ignites itself and the internal-combustion engine is started in this manner.

In a second preferred embodiment, the internal-combustion engine is provided as a direct-injecting Otto engine, in which case Otto fuel is injected in the proximity of the upper dead center and an ignition operation is triggered and the internal-combustion engine is started in this manner. Naturally, the internal-combustion engine may also be provided as a lean-mix engine (stratified-charge or Disotto engine).

Driving belts or toothed belts or a chain drive are provided as particularly reliable mechanical driving devices. These permit a low-maintenance drive of the camshaft by way of the mechanical driving device by the crankshaft of the internal-combustion engine, and thereby also the start of the internal-combustion engine according to the invention.

In this case, the driven camshaft may be provided as an inlet or outlet camshaft of the internal-combustion engine. As a function of the type of internal-combustion engine, a flexible use of the invention is thereby obtained.

Crankshaft sensors were found to be successful as the position determining devices. By way of corresponding projections or notches of the crankshaft, reliable conclusions can then be drawn about the position of the crankshaft and thus about the power cycle of the individual cylinders of the internal-combustion engine. In particular, it can also be determined when a cylinder is situated in the proximity of its upper dead center in order to thus provide an injection of fuel for starting the internal-combustion engine.

In a preferred embodiment, the separately drivable adjusting mechanism comprises a transmission, especially a planetary transmission. When the space requirements are low, a sufficient torque can also be applied in the case of a separate drive with a relatively low-power design in that a corresponding transmission ratio is used.

Particularly preferably, the separate drive of the adjusting mechanism is implemented electrically, particularly as an electric motor. Naturally, other types of drives may also be provided, such as an electro-hydraulic drive. In each case, a reliable operation of the separate drive is necessary when the internal-combustion engine is idle.

The process according to the invention utilizes the separately drivable adjusting mechanism for rotating the crankshaft. However, normally only a limited adjusting range is provided in order to protect the valves of the internal-combustion engine. As a result, it is advantageous to move the separately drivable adjusting mechanism into an end stop position when the internal-combustion engine is switched off. The reason is that, when the internal-combustion engine is started, according to the process of the invention, the entire adjusting range of the separately drivable adjusting mechanism will be available. In this case, the forward or rearward end stop of the separately drivable adjusting mechanism can be provided as end stop positions. In other words, as a result of the process according to the invention, the engine can be started in the forward or backward direction.

In a particularly preferred embodiment of the invention, the internal-combustion engine is constructed as a multi-bank engine with respectively assigned, separately driven adjusting mechanisms, the adjusting mechanisms being controlled in the same direction, for the addition of the torques transmitted by the separate drives—supported, for example, at the respective valves—by way of the mechanical driving devices to the crankshaft. The addition of the torques may be provided successively or simultaneously. With each triggered separate drive of a respective adjusting mechanism of a camshaft, the torque is increased that is transmitted to the crankshaft by way of the mechanical driving devices. As a result, also the torques for the rotation of the crankshaft are correspondingly increased and a reliable start of the internal-combustion is ensured.

In this case, the adjusting mechanism may also comprise a torque support which ensures a supporting, for example, in the direction opposite to the rotating direction, and thus the rotation of the crankshaft. For this purpose, for example, a free wheel may be provided on the camshaft or the crankshaft.

BRIEF DESCRIPTION OF THE DRAWING

The single FIGURE shows an electric camshaft adjusting device as an example, which is particularly suitable for implementing the process according to the invention.

DETAILED DESCRIPTION OF THE DRAWING

The crankshaft KW of an internal-combustion engine is schematically illustrated to which a camshaft NW is linked by way of a driving/toothed belt or a chain drive TM, for transmitting a rotating movement between the crankshaft KW and the camshaft NW. In this case, the internal-combustion engine is a direct-injecting Diesel or Otto engine. Additional driving/toothed belts or belt drives TMx may be provided at the crankshaft KW, for linking additional camshafts of the internal-combustion engine. This is schematically illustrated in the FIGURE by a broken line.

The driving/toothed belt or chain drive TM is part of a mechanical driving device for driving the camshaft NW and linked to a separately drivable adjusting mechanism. In addition, the mechanical driving device comprises a planetary transmission having a ring gear TR driven by the driving/toothed belt or chain drive TM. Furthermore, the planetary transmission comprises a (not shown) sun gear to which the camshaft NW is linked. Then a planet carrier VM is provided for connecting the ring gear TR with the sun gear. A separate drive in the form of an electric motor EM is coupled to the planet carrier. The electric motor EM is used for adjusting the camshaft NW within a certain angular range. Irrespective thereof, the camshaft NW is constantly rotated by the crankshaft KW by way of the driving/toothed belt or chain drive TM when the internal-combustion engine is operative.

For protecting the valves of the internal-combustion engine assigned to the camshaft NW, the adjusting mechanism, that is, the angular range in which the camshaft NW can be adjusted, is limited. For example, an adjusting range of 70° of the camshaft is customary. So that the ratio of the planetary transmission can be effective, the internal-combustion engine is started within the adjusting range of the camshaft adjusting device. For this reason, the camshaft adjusting device is moved into the end stop position when the internal-combustion engine is being switched off. For starting the internal-combustion engine, the electric camshaft adjustment is triggered which can transmit a torque from the electric motor EM by way of the mechanical driving devices to the crankshaft KW. The triggering causes an angular position change between the camshaft NW and the crankshaft KW. The adjustment takes place with the torque of the ratio of the planetary transmission, for example, a ratio of 1:60. Summarizing, this (as a result of the ratio of 1:2 between the crankshaft and the camshaft in the case of a four-cycle engine) leads to a ratio of 1:30. Thus, the differential rotational speed at the ring gear causes an adjustment of the crankshaft.

By triggering the electric motor EM, the planet carrier of the planetary transmission is therefore rotated. This rotating movement is transmitted to the sun gear and rotates the camshaft NW. Because the force for operating a valve of the internal-combustion engine is greater than the force for rotating the crankshaft KW, the electric motor EM now supports itself on the valve or on the valve spring supporting the latter, whereby the crankshaft KW is rotated by the electric motor EM of the electric camshaft adjusting device. The reason is that the cam resting against this blocking valve is supported on the valve spring and blocks the camshaft. In that, in the case of the planetary transmission, the sun gear connected with the camshaft is now blocking but the electric motor EM continues to drive the planetary transmission, the ring gear TR is now rotated by the electric motor EM. The rotating movement of the ring gear is transmitted by way of the driving/toothed belt or the chain drive TM to the crankshaft KW of the internal-combustion engine; for the moment of resistance at the camshaft NW is now greater than the moment of resistance at the crankshaft KW, whereby the crankshaft KW starts to move. As a result of the movement of the crankshaft KW, the working medium is now compressed in at least one cylinder space of the internal-combustion engine by the movement of the piston.

The position of the crankshaft KW is continuously determined by way of the crankshaft sensor PB of the internal-combustion engine. For this purpose, the indentations and elevations respectively placed at the defined points of the crankshaft KW are sensed and in this manner, by way of the position of the crankshaft, conclusions are drawn concerning the position of the pistons in the individual cylinders of the internal-combustion engine. It can thereby be determined in which of the cylinders of the internal-combustion engine the working medium is compressed by the rotation of the crankshaft KW. In the proximity of the upper dead center of the cylinder in which the working medium is maximally compressed, fuel is now injected and the internal-combustion engine is started in this fashion. In this case, the controlling of the starting operation according to the invention takes place by way of a control device SG, the starting operation of the internal-combustion engine being initiated by the control device SG upon receiving a starting command SB.

The starting operation according to the invention of a direct-injecting internal-combustion engine is particularly suitable for a use in vehicles having a start-stop system and in hybrid vehicles. When a starting operation according to the invention is provided in the case of vehicles having a start-stop system while the internal-combustion engine is in a hot-running condition, a conventional starter motor only still has to be provided for cold starts. As a result, the conventional starter motor can be designed for correspondingly fewer starting operations or, as required, can even be completely eliminated. In the case of hybrid vehicles, particularly in the case of a parallel full hybrid having an electric machine which is linked to the internal-combustion engine by way of a clutch and can be operated as a motor or a generator, an expanded electric driving range is conceivable. The reason is that no more torque reserve has to be provided at the electric machine for restarting the internal-combustion engine. In addition, there is an improvement in comfort during the restart.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A process for starting a direct-injecting internal-combustion engine, a crankshaft being provided for driving a camshaft (NW) of the internal-combustion engine by way of mechanical driving devices, the mechanical driving devices comprising an adjusting mechanism having an electric machine (EM) for adjusting the camshaft and operating the mechanical driving devices, and a position determining device (PB) for determining positions of pistons of cylinders of the internal-combustion engine;

wherein the process comprises the steps of:

switching off the internal-combustion engine using the electric motor when the internal-combustion engine is switched off to rotate the cam shaft within a specified angular range and until a cam rests on an end stop of a valve of the internal combustion engine and blocks the cam shaft, continuing using the electric motor to operate the mechanical driving devices to cause an angular position change between the crankshaft and the camshaft without opening the valve so that an unspecified piston of the internal combustion engine is moved into proximity to an upper dead center position of a corresponding cylinder and so that a working medium therein is compressed maximally;

determining the positions of the pistons of the internal combustion engine by using the determining device prior to a subsequent starting of the internal combustion engine for identifying the cylinder of the internal combustion engine that has the working medium therein maximally compressed;

issuing a starting command; and injecting fuel into the cylinder determined by the determining device to have the working medium maximally compressed when the piston thereof is in the selected proximity to the upper dead center, for starting the internal-combustion engine.

2. The process according to claim 1, wherein the internal-combustion engine is constructed as a direct-injecting diesel engine, whereby diesel fuel is injected in the proximity of the upper dead center, which diesel fuel ignites itself, and the internal-combustion engine is started in this manner.

3. The process according to claim 1, wherein the internal-combustion engine is constructed as a direct-injecting Otto engine, wherein Otto fuel is injected in the proximity of the upper dead center and an ignition operation is triggered to start the internal-combustion engine.

4. The process according to claim 1, wherein the internal-combustion engine is started selectively by rotating the crankshaft in a forward running direction of the internal-combustion engine or by rotating the crankshaft against the running direction of the internal-combustion engine.

5. The process according to claim 1, wherein the internal-combustion engine is constructed as a multi-bank engine, having adjusting mechanisms in each case assigned to the camshafts and having respective separate drives, wherein the respective adjusting mechanisms are controlled in a same direction, for an addition of torques transmitted from the separate drives by way of respective mechanical driving devices to the crankshaft.

6. A system for starting a direct-injecting internal-combustion engine, the internal-combustion engine having a crankshaft, a camshaft and a mechanical driving toothed belt or chain drive for transmitting a driving force between the crankshaft and the camshaft of the internal-combustion engine, the system comprising:

an adjusting mechanism having a separate drive and a planetary transmission with a ring gear having inner teeth engaged with the separate drive and outer teeth engaged with the driving toothed belt or chain drive for rotatinq the camshaft until a cam rests approximately on an end stop of a valve of the internal combustion engine thereby blocking the camshaft and for subsequently operating the planetary transmission and driving the toothed belt or chain drive for causing an angular position change between the crankshaft and the camshaft;

detection devices for detecting a start-related signal for the internal-combustion engine;

triggering devices for triggering the separate drive for causing, by way of the adjusting mechanism, the angular position change between the crankshaft and the camshaft until the separate drive rotates the crankshaft by way of the planetary transmission and the toothed belt or the chain drive without opening the valve of the internal-combustion engine so that a working medium in at least one unspecified cylinder is compressed maximally by a piston in the cylinder;

determining devices for determining the positions of the pistons of the internal-combustion engine to identify which of the unspecified cylinders of the internal-combustion engine has the working medium maximally compressed; and output devices for output of a command for starting the internal combustion engine by injecting fuel into the cylinder of the internal combustion engine in which the working medium is determined by the determining devices to have been maximally compressed by the piston of the cylinder being in proximity of an upper dead center, for starting the internal combustion engine.

7. The system according to claim 6, wherein the camshaft is constructed as an inlet or outlet camshaft for operating inlet or outlet cams of the internal-combustion engine.

8. The system according to claim 6, wherein the determining devices are constructed as crankshaft sensors in order to be able to determine the positions of the pistons of cylinders of the internal-combustion engine.

9. The system according to claim 6, wherein the separate drive is an electric motor.

10. A motor vehicle having a system according to claim 6.

11. The motor vehicle according to claim 10, wherein the motor vehicle is provided as a parallel full hybrid having an electric machine linked by way of a clutch to the internal combustion engine and operable as a motor or a generator.

* * * * *